US007410426B2

(12) United States Patent
Willett et al.

(10) Patent No.: US 7,410,426 B2
(45) **Date of Patent: *Aug. 12, 2008**

(54) GOLF CLUB HEAD HAVING REMOVABLE WEIGHT

(75) Inventors: Kraig A. Willett, Fallbrook, CA (US); Joseph H. Hoffman, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/647,883

(22) Filed: Dec. 29, 2006

(65) Prior Publication Data

US 2007/0142121 A1 Jun. 21, 2007

Related U.S. Application Data

(60) Division of application No. 10/913,001, filed on Aug. 6, 2004, now Pat. No. 7,223,180, which is a continuation of application No. 10/290,817, filed on Nov. 8, 2002, now Pat. No. 6,773,360.

(51) Int. Cl.
*A63B 53/04* (2006.01)
*A63B 53/06* (2006.01)

(52) U.S. Cl. ..... 473/334; 473/338; 473/345

(58) Field of Classification Search ..... 473/324–350, 473/290, 291, 519, 297; 411/280, 534, 368, 411/369, 934

See application file for complete search history.

(56) References Cited

U.S. PATENT DOCUMENTS

| | | | |
|---|---|---|---|
| 1,213,382 | A | 1/1917 | Kent |
| 1,518,316 | A | 12/1924 | Ellingham |
| 1,526,438 | A | 2/1925 | Scott |
| 1,538,312 | A | 5/1925 | Beat |
| 1,568,888 | A | 1/1926 | Dunn |

(Continued)

FOREIGN PATENT DOCUMENTS

| | | |
|---|---|---|
| DE | 9012884 | 11/1990 |
| EP | 1001175 | 5/2000 |
| GB | 194823 | 3/1923 |
| JP | 05317465 | 12/1993 |
| JP | 06-126004 | 5/1994 |

(Continued)

OTHER PUBLICATIONS

Jackson, Jeff, The Modern Guide To Golf Clubmaking, Ohio: Dynacraft Golf Products, Inc., copyright 1994, p. 237.

*Primary Examiner*—Sebastiano Passaniti
(74) *Attorney, Agent, or Firm*—Sheppard, Mullin, Richter & Hampton LLP

(57) ABSTRACT

The invention provides a golf club head having adjustable weight, allowing the golfer to fine tune the club for his or her swing. The club head includes a body having a ball-striking face, a sole, a crown, and a side extending rearwurdly from the face. The body defines an interior cavity and a recess on a selected wall of the body spaced apart from the striking face. A threaded opening is disposed in the recess. The club head farther includes a weight assembly having fastener end a mass element configured to be press-fit into the recess the such that a first end is adjacent the bottom of the recess. The mass element also has an aperture configured to receive the fastener flush. The fastener removably attaches the weighting assembly to the selected wall of the club head. Pressure from the fastener attachment provides a press-fit of the mass element in the tapered recess of the selected wall.

16 Claims, 4 Drawing Sheets

U.S. PATENT DOCUMENTS

| | | | | |
|---|---|---|---|---|
| 1,592,463 | A | | 7/1926 | Marker |
| 1,756,219 | A | | 4/1930 | Spiker |
| 1,868,286 | A | | 7/1932 | Grieve |
| 2,067,556 | A | | 1/1937 | Wettlaufer |
| 2,163,091 | A | | 6/1939 | Held |
| 2,171,383 | A | | 8/1939 | Wettlaufer |
| 2,198,981 | A | | 4/1940 | Sullivan |
| 2,225,930 | A | | 12/1940 | Sexton |
| 2,360,364 | A | | 10/1944 | Reach |
| 2,460,445 | A | | 2/1949 | Bigler |
| 3,064,980 | A | | 11/1962 | Steiner |
| 3,466,047 | A | | 9/1969 | Rodia et al. |
| 3,589,731 | A | | 6/1971 | Chancellor, Jr. |
| 3,606,327 | A | | 9/1971 | Gorman |
| 3,610,630 | A | | 10/1971 | Glover |
| 3,652,094 | A | | 3/1972 | Glover |
| 3,692,306 | A | | 9/1972 | Glover |
| 3,743,297 | A | | 7/1973 | Dennis |
| 3,749,408 | A | | 7/1973 | Mills |
| 3,897,066 | A | | 7/1975 | Belmont |
| 3,976,299 | A | | 8/1976 | Lawrence et al. |
| 3,979,122 | A | | 9/1976 | Belmont |
| 3,979,123 | A | | 9/1976 | Belmont |
| 4,008,896 | A | | 2/1977 | Gordos |
| 4,043,563 | A | | 8/1977 | Churchward |
| 4,052,075 | A | | 10/1977 | Daly |
| 4,076,254 | A | | 2/1978 | Nygren |
| 4,085,934 | A | | 4/1978 | Chruchward |
| 4,121,832 | A | | 10/1978 | Ebbing |
| 4,214,754 | A | | 7/1980 | Zebelean |
| 4,262,562 | A | | 4/1981 | MacNeill |
| 4,340,229 | A | * | 7/1982 | Stuff, Jr. ..... 473/240 |
| 4,411,430 | A | | 10/1983 | Dian |
| 4,417,731 | A | | 11/1983 | Yamada |
| 4,423,874 | A | | 1/1984 | Stuff, Jr. |
| 4,438,931 | A | | 3/1984 | Motomiya |
| 4,530,505 | A | | 7/1985 | Stuff |
| 4,607,846 | A | | 8/1986 | Perkins |
| 4,730,830 | A | | 3/1988 | Tilley |
| 4,736,093 | A | | 4/1988 | Braly |
| 4,754,977 | A | | 7/1988 | Sahm |
| 4,795,159 | A | | 1/1989 | Nagamoto |
| 4,824,116 | A | | 4/1989 | Nagamoto et al. |
| 4,867,457 | A | | 9/1989 | Lowe |
| 4,869,507 | A | | 9/1989 | Sahm |
| 4,895,371 | A | | 1/1990 | Bushner |
| 4,962,932 | A | | 10/1990 | Anderson |
| 5,013,041 | A | | 5/1991 | Sun et al. |
| 5,050,879 | A | | 9/1991 | Sun et al. |
| 5,056,705 | A | | 10/1991 | Wakita et al. |
| 5,058,895 | A | | 10/1991 | Igarashi |
| 5,082,278 | A | | 1/1992 | Hsien |
| 5,219,408 | A | | 6/1993 | Sun |
| 5,244,210 | A | | 9/1993 | Au |
| 5,253,869 | A | | 10/1993 | Dingle et al. |
| 5,273,283 | A | | 12/1993 | Bowland |
| 5,289,865 | A | | 3/1994 | Sun |
| 5,316,305 | A | | 5/1994 | McCabe |
| 5,320,005 | A | | 6/1994 | Hsiao |
| 5,385,348 | A | | 1/1995 | Wargo |
| 5,407,202 | A | | 4/1995 | Igarashi |
| 5,410,798 | A | | 5/1995 | Lo |
| 5,421,577 | A | | 6/1995 | Kobayashi |
| 5,439,222 | A | | 8/1995 | Kranenberg |
| 5,441,274 | A | | 8/1995 | Clay |
| 5,481,093 | A | | 1/1996 | Rogerson |
| 5,518,243 | A | | 5/1996 | Redman |
| 5,522,593 | A | | 6/1996 | Kobayashi et al. |
| 5,533,730 | A | | 7/1996 | Ruvang |
| 5,571,053 | A | | 11/1996 | Lane |
| 5,603,499 | A | | 2/1997 | Jagosz |
| 5,629,475 | A | | 5/1997 | Chastonay |
| 5,669,827 | A | | 9/1997 | Nagamoto |
| 5,683,309 | A | | 11/1997 | Reimers |
| 5,709,613 | A | | 1/1998 | Sheraw |
| 5,718,641 | A | | 2/1998 | Lin |
| 5,746,664 | A | * | 5/1998 | Reynolds, Jr. ..... 473/252 |
| 5,755,624 | A | | 5/1998 | Helmstetter |
| 5,755,627 | A | | 5/1998 | Yamazaki et al. |
| 5,769,737 | A | | 6/1998 | Holladay et al. |
| 5,776,011 | A | | 7/1998 | Su et al. |
| RE35,955 | E | | 11/1998 | Lu |
| 5,851,160 | A | | 12/1998 | Rugge et al. |
| 5,855,525 | A | | 1/1999 | Turner |
| 5,908,356 | A | | 6/1999 | Nagamoto |
| 5,911,638 | A | | 6/1999 | Parente et al. |
| 5,935,019 | A | | 8/1999 | Yamamoto |
| 5,947,840 | A | | 9/1999 | Ryan |
| 5,967,905 | A | | 10/1999 | Nakahara et al. |
| 5,997,415 | A | | 12/1999 | Wood |
| 6,001,024 | A | | 12/1999 | Van Alen, II |
| 6,015,354 | A | | 1/2000 | Ahn et al. |
| 6,019,686 | A | | 2/2000 | Gray |
| 6,023,891 | A | | 2/2000 | Robertson et al. |
| 6,030,295 | A | | 2/2000 | Takeda |
| 6,032,677 | A | | 3/2000 | Blechman et al. |
| 6,056,649 | A | | 5/2000 | Imai |
| 6,089,994 | A | | 7/2000 | Sun |
| 6,149,533 | A | | 11/2000 | Finn |
| 6,162,133 | A | | 12/2000 | Peterson |
| 6,206,790 | B1 | | 3/2001 | Kubica et al. |
| 6,238,303 | B1 | | 5/2001 | Fite |
| 6,248,025 | B1 | | 6/2001 | Murphy et al. |
| 6,270,422 | B1 | | 8/2001 | Fisher |
| 6,277,032 | B1 | | 8/2001 | Smith |
| 6,290,609 | B1 | | 9/2001 | Takeda |
| 6,296,579 | B1 | | 10/2001 | Robinson |
| 6,299,547 | B1 | | 10/2001 | Kosmatka |
| 6,306,048 | B1 | | 10/2001 | McCabe et al. |
| 6,309,311 | B1 | | 10/2001 | Lu |
| 6,315,678 | B1 | | 11/2001 | Teramoto |
| 6,348,014 | B1 | | 2/2002 | Chiu |
| 6,379,265 | B1 | | 4/2002 | Hirakawa et al. |
| 6,383,090 | B1 | | 5/2002 | O'Doherty et al. |
| 6,390,933 | B1 | | 5/2002 | Galloway et al. |
| 6,409,612 | B1 | | 6/2002 | Evans et al. |
| 6,436,142 | B1 | | 8/2002 | Paes et al. |
| 6,440,009 | B1 | | 8/2002 | Giubaud et al. |
| 6,443,851 | B1 | | 9/2002 | Liberatore |
| 6,458,044 | B1 | | 10/2002 | Vincent et al. |
| 6,514,154 | B1 | | 2/2003 | Finn |
| 6,524,197 | B2 | | 2/2003 | Boone |
| 6,527,649 | B1 | | 3/2003 | Neher et al. |
| 6,530,848 | B2 | | 3/2003 | Gillig |
| 6,565,448 | B2 | | 5/2003 | Cameron et al. |
| 6,641,487 | B1 | | 11/2003 | Hamburger |
| 6,648,772 | B2 | | 11/2003 | Vincent et al. |
| 6,716,111 | B2 | | 4/2004 | Liberatore |
| 6,739,983 | B2 | | 5/2004 | Helmstetter et al. |
| 6,773,360 | B2 | * | 8/2004 | Willett et al. ..... 473/334 |
| 6,923,734 | B2 | | 8/2005 | Meyer |
| 6,991,558 | B2 | | 1/2006 | Beach et al. |
| 6,998,960 | B2 | | 2/2006 | Buschmann et al. |
| 7,004,852 | B2 | | 2/2006 | Billings |
| 7,147,570 | B2 | | 12/2006 | Toulon et al. |
| 7,166,040 | B2 | * | 1/2007 | Hoffman et al. ..... 473/334 |
| 7,223,180 | B2 | * | 5/2007 | Willett et al. ..... 473/334 |
| 2001/0049310 | A1 | | 12/2001 | Cheng et al. |
| 2002/0022535 | A1 | | 2/2002 | Takeda |
| 2002/0032075 | A1 | | 3/2002 | Vatsvop |
| 2002/0072434 | A1 | | 6/2002 | Yabu |
| 2002/0137576 | A1 | | 9/2002 | Dammen |
| 2002/0160854 | A1 | | 10/2002 | Beach et al. |
| 2003/0130059 | A1 | | 7/2003 | Billings |

| | | | |
|---|---|---|---|
| 2004/0087388 | A1 | 5/2004 | Beach et al. |
| 2004/0242343 | A1 | 12/2004 | Chao et al. |

FOREIGN PATENT DOCUMENTS

| | | |
|---|---|---|
| JP | 06304271 | 11/1994 |
| JP | 09-028844 | 2/1997 |
| JP | 09308717 | 12/1997 |
| JP | 09327534 | 12/1997 |
| JP | 10234902 | 9/1998 |
| WO | WO 8802642 | 4/1998 |
| WO | WO 01/66199 | 9/2001 |
| WO | WO 02062501 | 8/2002 |
| WO | WO 03/061773 | 7/2003 |

* cited by examiner

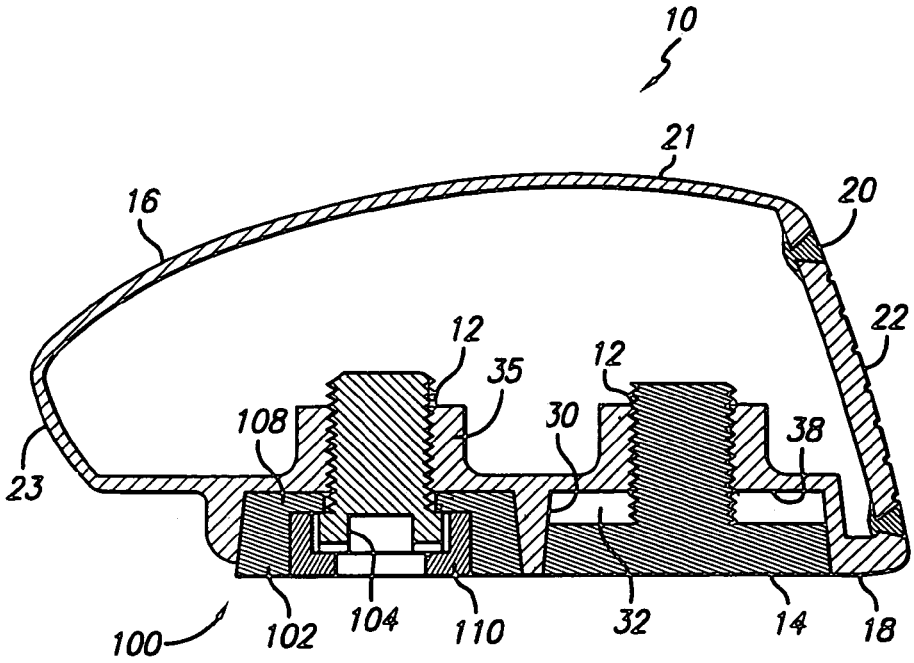
FIG. 1
FIG. 2A
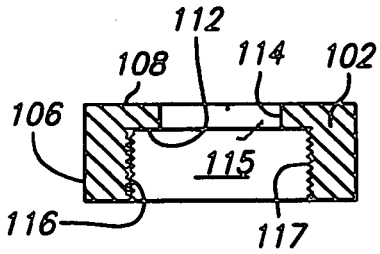
FIG. 2B
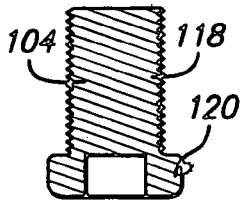
FIG. 2C
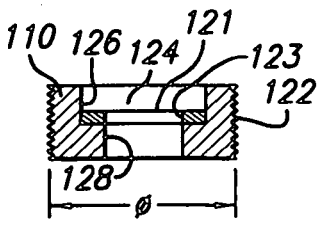
FIG. 2D
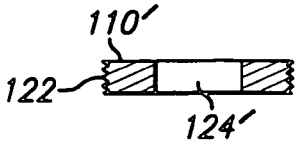

GOLF CLUB HEAD HAVING REMOVABLE WEIGHT

CROSS-REFERENCE TO RELATED APPLICATION

This is a divisional of prior application Ser. No. 10/913,001, filed Aug. 6, 2004 now U.S. Pat. No. 7,223,180, which is a continuation of prior application Ser. No. 10/290,817, filed Nov. 8, 2002, now U.S. Pat. No. 6,773,360, which is herein incorporated by reference.

FIELD OF THE INVENTION

The invention relates generally to a golf club head and, more particularly, to a wood-type golf club head having a volume of at least 150 cc.

BACKGROUND OF THE INVENTION

Current driver and fairway wood golf club heads are typically formed of steel or titanium alloys. For example, oversize driver heads exceeding 300 cc in volume are usually formed of a lightweight titanium alloy such as Ti 6Al-4V. Unless modified, oversize heads can have a relatively high center of gravity, which can adversely affect launch angle and flight trajectory of a struck golf ball. Thus, many club heads have integral sole weight pads cast into the head at a predetermined location to lower the center of gravity of the club head. Also, epoxy may be later added to the club head through the hosel to obtain a final desired weight of the club head. Alternatively, club heads may have weights, usually of a higher density material than the titanium or steel alloy, externally attached to the sole. The weights may be welded in place or attached using a fastener such as a screw. Because of the repeated contact with the ground during the golfer's swings, use of an adhesive alone is not advised as a long term, external attachment method for a weight.

These weights are of a prescribed amount and are usually pennanently attached to the club head prior to purchase. However, the club's weighting typically is set for a standard, or ideal, swing type. Thus, even though the weight may be too light or too heavy, or too far forward or too far rearward, a golfer with a less than ideal swing type cannot adjust or customize the club weighting to accommodate his or her particular needs.

It should, therefore, be appreciated that there is a need for a golf club head that allows a golfer to fine tune the weight of the club head for his or her swing. The present invention fulfills this need and others.

SUMMARY OF THE INVENTION

The invention provides a golf club head having adjustable weight, allowing the golfer to fine tune the club for his or her swing. The club head includes a body having a ball-striking face, a sole, a crown, and a side extending rearwardly from the face. The body defines an interior cavity and a recess on a selected wall of the body spaced apart from the striking face. A threaded opening is disposed in the recess. The club head further includes a weight assembly having a fastener and a mass element configured to be press-fit into the recess the such that a first end is adjacent the bottom of the recess. The mass element also has an aperture configured to receive the fastener flush. The fastener removably attaches the weighting assembly to the bottom wall of the club head. Pressure from the fastener attachment provides a press-fit of the mass element in the recess. Thus, a golfer can try out a selected first weight on the club head and then change to a different second weight that may be more desirable in its mass and/or mass distribution properties.

In a preferred embodiment, the weight assembly further includes a retaining element configured to retain the fastener the aperture in the mass element and to receive the tip of a tool for tightening or loosening the fastener. The retaining element also serves to aid in removing the mass element when the fastener is loosened, as the head of the fastener presses against the retaining element in an outward direction while the retaining element is secured to the mass element. Preferably there is a low friction element positioned between the head of the fastener and the retaining element. The mass and retaining elements move in concert as the fastener is loosened from the selected wall.

In a detailed aspect of a preferred embodiment, the mass element may be configured in various shapes and densities. For example, the weight assembly can have a triangular shape and one side portion could be different in density. Thus, the weight assembly could move the center of gravity slightly forward, slightly to the toe and rear or slightly to the rear and heel, depending upon the arrangement of the heavier side portion. Other shapes of the weight assembly can be employed for different weighting schemes as well as for cosmetic effect.

In another detailed aspect of a preferred embodiment, the body defines a plurality of recesses for receiving a weight assembly. Optionally, a combination of a weight assemblies and plugs can be secured in the plurality of recesses.

For purposes of summarizing the invention and the advantages achieved over the prior art, certain advantages of the invention have been described herein above. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Embodiments of the present invention will now be described, by way of example only, with reference to the following drawings in which:

FIG. 1 is a cross-sectional view of a first preferred embodiment of a club head in accordance with the invention, showing a plug and a removable weight attached to the sole of the club head.

FIG. 2A is a cross-sectional view of a mass element for the club head of FIG. 1.

FIG. 2B is a cross-sectional view of a screw to be received through the mass element of FIG. 2A.

FIG. 2C is a cross-sectional view of a retaining element for the club head of FIG. 1.

FIG. 2D is a cross-sectional view of an alternative retaining element for the club head of FIG. 1.

DETAILED DESCRIPTION OF THE PREFERRED EMBODIMENTS

Figure 3A:
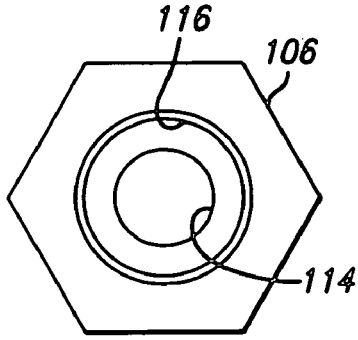
FIG. 3A is a plan view of the exposed end of the mass element of FIG. 2A.

Now with reference to the illustrative drawing, and particularly FIG. 1, there is shown a club head 10 having a main body 16 and removable weight assembly 100 secured in one of a plurality of recesses 32. The weight assembly 100 includes a mass element 102, a screw 104 and a retaining element 110. The recesses 32 can interchangeably receive a weight assembly 100 or a plug 14. The plug 14 is preferably formed of a material having similar density of the main body 16. By having more than one recess 32, a golfer can fine tune the weighting of the club head 10 by locating weight assemblies 100 forward toward a front wall 20 or rearward away from the front wall 20.

Figure 4:
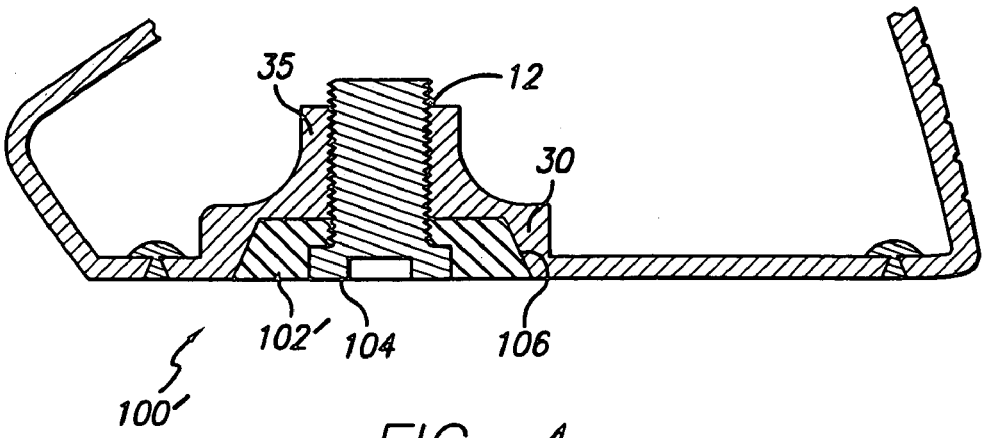
FIG. 4 is a partial cross-sectional view of a second preferred embodiment of a club head in accordance with the invention, depicting a single attachment to the sole of the club head.
Figure 6:
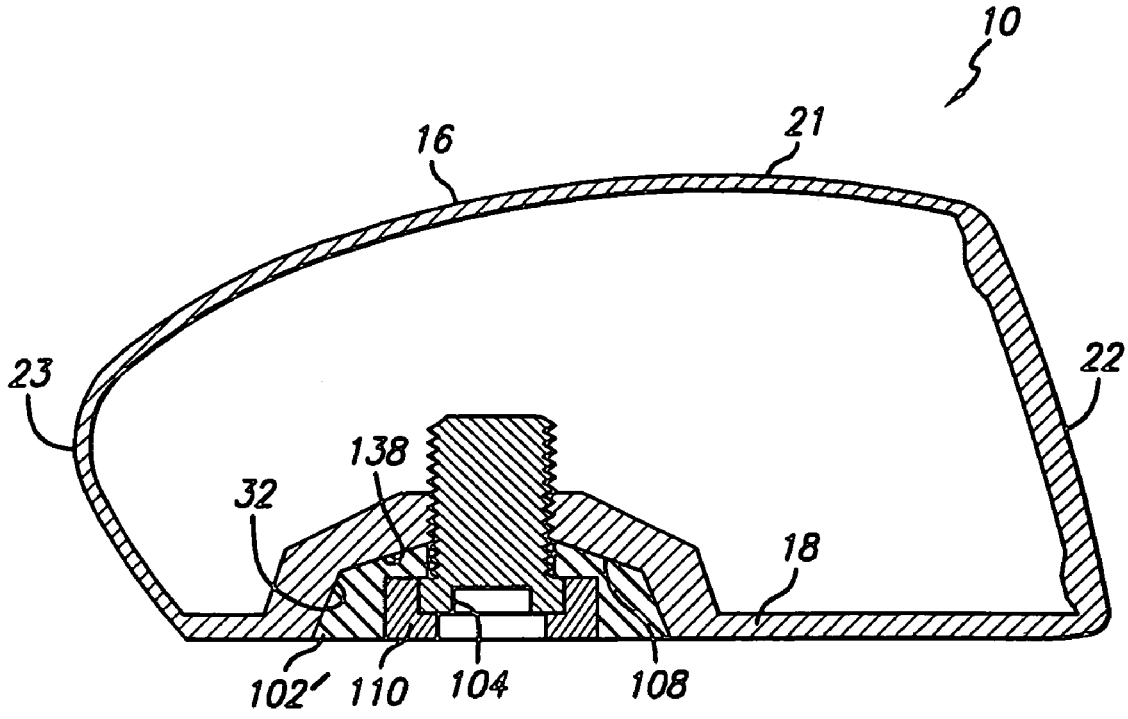
FIG. 6 is a sectional view of a third preferred embodiment of the present invention.

The main body 16 is formed of metal and a striking face 22 may be integrally formed or attached to the main body 16 using methods known to those skilled in the art. A sole 18 may be integrally formed with the main body 16 or separately formed then attached to the main body 16 (FIG. 4). The recess 32 is defined by a recess wall 30 and a recess bottom 38. The recess bottom 38 defines a threaded opening 12 for attachment of the weight assembly 100. As shown in FIGS. 1 and 4, the recess wall 30 may be tapered and the threaded opening 12 may be further defined by a boss 35 extending either inward (FIG. 1) or outward (FIG. 4) relative to the recess 32. In this embodiment, the boss 35 has a length at least half the length of the body of the screw 104 and, more preferably, the boss 35 has a length at least 1.5 times a diameter of the body of the screw 104. Alternatively, as shown in FIG. 6, the threaded opening 12 may be formed without a boss 35.

With continued reference to FIG. 1, the recess 32 is defined on the sole 18 and the mass element 102 is secured in place using the screw 104. Another user removable fastener such as a bolt may alternatively be used. The pressure from the engagement of the screw 104 provides a press-fit of the mass element 102 into the recess 32 on the sole 18, as sides 106 of the mass element 102 slide tightly against the recess side wall 30. A bottom end surface 108 of the mass element 102 preferably contacts the recess bottom 38; however, retention of the weight assembly 100 derives substantially from the press-fit between the sides 106 of the mass element 102 and the recess side wall 30. The retaining element 110 allows for easy removal of the mass element 102. This feature allows the club head 10 to be modified by a golfer who seeks to configure the club head 10 with more than one weight assembly 100 at the one or more recesses 32 on the sole 18. Upon determination of the final desired weighting of the sole 18, the weight assembly 100 is left securely attached to the club head 10 for play. The recesses 32 may also be located more toward a toe or a heel of the club head 10, as desired. In alternative embodiments, the one or more recesses 32 may be provided on a top wall 21 or side wall 23 of the main body 16 to allow weighting at that portion of the club head 10.

Figure 3B:
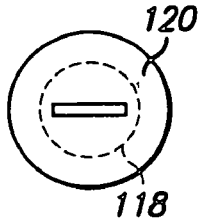
FIG. 3B is a top plan view of the screw of FIG. 2B.

Referring to FIGS. 2A and 3A, the mass element 102 has a hexagonal shape and defines an aperture 112 sized to freely receive the screw 104. As shown in FIG. 2A, the aperture 112 has a first diameter at a first end 114 that is smaller than a second diameter at a recess 115 in a second end 116. The first diameter is sized to freely receive a body 118 (FIG. 2B) of the screw 104 and the second diameter is sized to receive the retaining element 110. The second end 116 of the mass element 102 having the second diameter has internal threads 117 for securing the retaining element 110 over a head 120 of the screw 104 (see FIG. 3B).

Figure 3C:
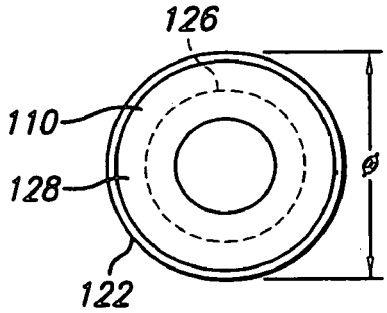
FIG. 3C is a plan view of the exposed end of the retaining element of FIG. 2C.

FIGS. 2C and 3C show the retaining element 110 having an outer diameter (ϕ) and an outer surface 122 that includes threads to mate with the internal threads 117 of the mass element 102. Preferably, the retaining element 110 has an aperture 124 that has a first diameter at an inner end 126 that is greater than a second diameter at an outer end 128. The first diameter is sized to freely receive the head 120 of the screw 104. More preferably, a low-friction element 121 having low-friction surfaces is sized to be received in the retaining element aperture 124 at the inner end 126. The low-friction element 121 has an aperture 123 having substantially the same diameter as the second diameter at the outer end 128 of the retaining element aperture 124.

With reference now to FIG. 2D, an alternative retaining element 110' may be provided having an aperture 124' with a single diameter. The low-friction element 121 may then have an outer diameter corresponding to the outer diameter of the retaining element 110'. The apertures of the low-friction element 121 and the retaining element 110' are both sized to receive a tip end of a screwdriver (not shown) for tightening and/or loosening the screw. When assembled, the screw head 120 is between the mass element 102 and retaining element 110'. For other types of fasteners, the apertures of the low-friction element 121 and the retaining element 110' are preferably sized to receive the appropriate fastening tool. Also, instead of a separate low-friction element 121, appropriate surfaces of the retaining element 110' adjacent to the screw head 120 may be treated to obtain similar low friction characteristics so that outward rotation of the screw 104 does not cause rotation of the retaining element 110'.

With reference again to FIG. 1, the weight assembly 100 comprises a conventional screw 104 and the material of the mass element 102 has a density different from the density of the material of the main body 16. The retaining element 110 may comprise any material and is preferably a metal. As shown in FIG. 3A, as well as FIGS. 5A-5C, the mass element 102 may have any outer shape, such as triangular, oval or rectangular. After the desired weight assembly configuration is determined and confirmed to meet the needs of a golfer, adhesive may be applied to the threaded body 118 of the screw 104 to further secure the weight assembly 100 to the club head 10. Of course, heating or other methods known to those skilled in the art may be used to allow removal of the weight assembly 100 if adhesive has been applied.

For installation of the weight assembly 100 of FIG. 1, the screw head 120 is preferably placed into the inner end 126 of the retaining element 110 and then the body 118 of the screw 104 is placed through the aperture 112 of the mass element 102. The head 120 is trapped between the retaining element 110 and the mass element 102 as the retaining element 110 is screwed into place. The threaded body 118 of the screw 104 is screwed into the threaded opening 12 of the recess 32. A screwdriver engages the head 120 of the screw 104 through the retaining element aperture 124, and as the screw 104 engages the threads of the threaded opening 12, the weight assembly 100 achieves a press-fit against the tapered recess wall 30. This embodiment also allows easier removal of the weight assembly 100, if desired, since as the screwdriver turns the head 120 of the screw 104, the screw 104 applies an outward force on the retaining element 110 and thus helps to decouple the mass element 102 from the tapered recess wall 30.

Advantages of the present invention may be obtained without the use of the retaining element 110, as illustrated in a preferred embodiment of FIG. 4. In this embodiment the weight assembly 100' includes a mass element 102' and a screw 104. The engagement of the screw 104 into the threaded opening 12 causes the sides 106 of the mass element 102' to be compressed against the tapered recess wall 30, thereby achieving a secure press-fit.

With reference now to FIG. 6, another preferred embodiment of a club head 10 having a retaining element 110 with a mass element 102' and screw 104 is shown. A recess bottom 138 is configured to have a taper steeper than the recess side wall 30. The mass element 102' may have a complementary bottom end surface 108' to contact the recess bottom 138. Alternatively, the mass element 102' may have a substantially planar bottom end surface 108 that is tightly compressed against the tapered recess bottom 138 as the screw 104 is engaged.

Figure 5A:
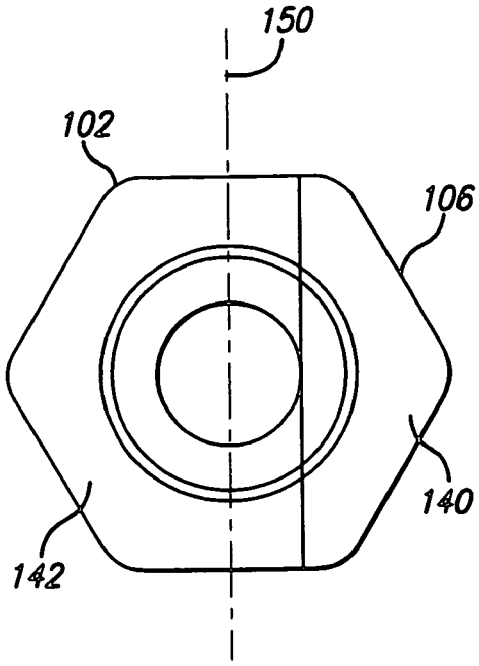
FIG. 5A is a plan view of the exposed end of an alternative mass element similar to FIG. 3A, depicting two different density regions within the mass element.
Figure 5B:
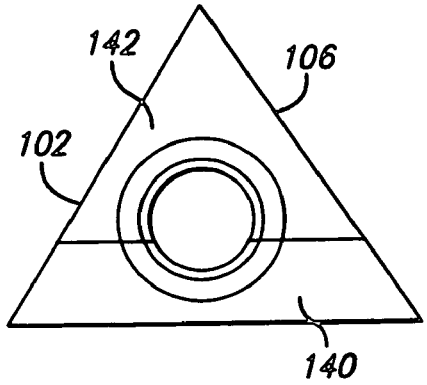
FIG. 5B is a plan view of the exposed end of another mass element, having a triangular shape and having a density that is different along one side from the remaining two sides.
Figure 5C:
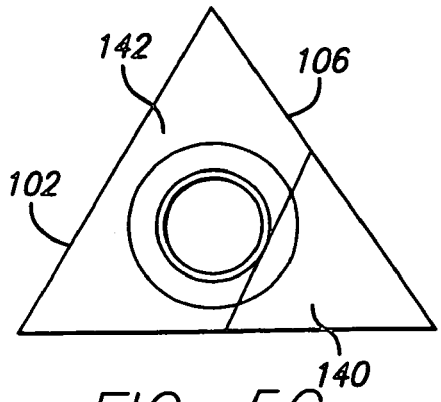
FIG. 5C is a plan view of the exposed end of yet another mass element similar to FIG. 5B and having a different density in one of the three corners.

With reference now to FIGS. 5A-5C, the mass element 102, 102' may have at least one axis of symmetry 150 and a higher density region 140 that has a higher density than a lower density region 142 of the mass element 102, 102'. Thus, the moment of inertia and center of gravity of the club head 10 may be altered by changing the orientation of the mass element 102, 102' in the recess 32. For example, the higher density region 140 may be aligned toward the front, toe, heel and/or rear direction of the club head 10. Examples of such a mass element 102, 102' are a hexagonal-shaped mass element with a higher density region 140 (FIG. 5A), a triangular-shaped mass element with a higher density region 140 (FIG. 5B), and a triangular-shaped mass element 102, 102' with a higher density region 140 (FIG. 5C). The different density regions 140, 142 of the mass element 102, 102' may be achieved by methods known to those skilled in the art, such as using compression and sintering techniques, as in powder metallurgy, to achieve the desired density distribution in a metal product.

Figure 7:
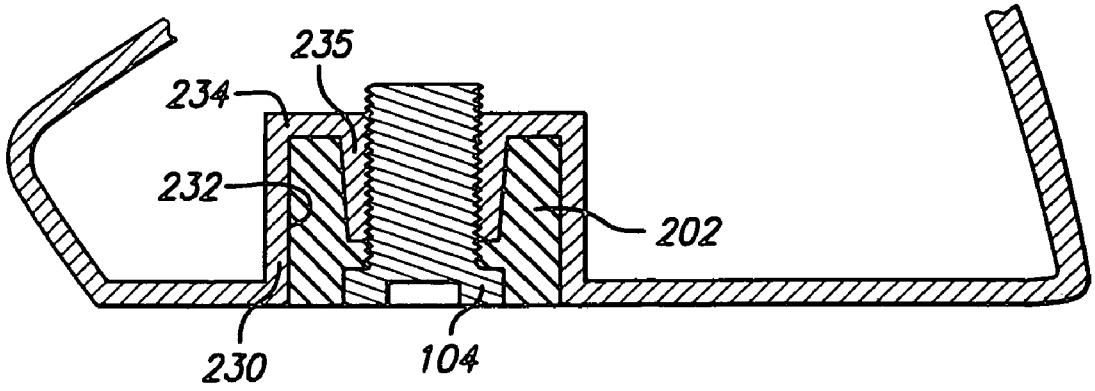
FIG. 7 is a partial sectional view of a fourth preferred embodiment of the present invention.

Yet another embodiment of the present invention is shown in the partial sectional view of FIG. 7. The recess 232 has substantially straight walls 230 formed toward the interior of the club head 10, and a boss 235 located in the recess 232. A recess bottom wall 234 that forms the boss 235 is tapered outwardly. The mass element 202 has substantially straight, parallel walls, and the pressure by the screw 104 is focused on the inner walls of the mass element 202 to press-fit the weight assembly in the recess 232. It is understood that a retaining element, comprising a low friction surface, may be used with the mass element 202 to form the removable weight assembly.

Although the invention has been disclosed in detail with reference only to the preferred embodiments, those skilled in the art will appreciate that additional golf club heads can be made without departing from the scope of the invention. Accordingly, the invention is defined only by the claims set forth below.

We claim:

1. A removable weight assembly for a golf club head, the weight assembly comprising;

a mass element;

a first aperture having a first diameter formed in the mass element;

a second aperture having a second diameter formed in the mass element;

a cavity formed in the mass element and extending between the first and second apertures, the cavity having a maximum diameter greater than the first and second diameters; and a fastener having a fastener head and a fastener body, the fastener head having a third diameter greater than the first and second diameters and less than the cavity maximum diameter, wherein the fastener head is disposed in the cavity, and the fastener body extends through the first aperture such that the fastener head is retained in the cavity.

2. The removable weight assembly of claim 1, wherein the fastener body is adapted to be removably engaged with a portion of a golf club head.

3. The removable weight assembly of claim 1, wherein the first second diameter is adapted to provide tool access to the fastener head.

4. The removable weight assembly of claim 1, wherein a cross sectional shape of the mass element is triangular, hexagonal, oval, or rectangular.

5. The removable weight assembly of claim 1, wherein the mass element has a uniform density.

6. The removable weight assembly of claim 1, wherein the mass element has a non-uniform density.

7. The removable weight assembly of claim 1, further comprising a low friction element disposed between the fastener head and the mass element.

8. A removable weight assembly for a golf club head, the weight assembly comprising;

a mass element;

a first aperture having a first diameter formed in the mass element;

a second aperture having a second diameter formed in the mass element;

a cavity formed in the mass element and extending between the first and second apertures;

a fastener having a fastener head and a fastener body, the fastener head having a third diameter, wherein the fastener head is disposed in the cavity through the second aperture, the fastener body extends through the first aperture, and the second diameter is greater than the first and third diameters; and a retaining element coupled to the mass element at the second aperture to retain the fastener head in the cavity.

9. The removable weight assembly of claim 8, wherein the fastener body is adapted to be removably engaged with a portion of a golf club head.

10. The removable weight assembly of claim 8, wherein the retaining element includes a fourth aperture to provide tool access to the fastener head, the fourth aperture having a fourth diameter less than the third diameter.

11. The removable weight assembly of claim 10, wherein the retaining element includes a fifth aperture having a fifth diameter greater than the fastener head third diameter, wherein the fifth diameter is adapted to receive the fastener head when the retaining element is coupled to the mass element.

12. The removable weight assembly of claim 8, wherein a cross sectional shape of the mass element is triangular, hexagonal, oval, or rectangular.

13. The removable weight assembly of claim 8, wherein the mass element has a uniform density.

14. The removable weight assembly of claim 8, wherein the mass element has a non-uniform density.

15. The removable weight assembly of claim 8, further comprising a low friction element disposed between the fastener head and the retaining element.

16. The removable weight assembly of claim 8, wherein the retaining element is adapted to be threadably engaged with the weight assembly.

* * * * *

UNITED STATES PATENT AND TRADEMARK OFFICE

CERTIFICATE OF CORRECTION

PATENT NO. : 7,410,426 B2
APPLICATION NO. : 11/647883
DATED : August 12, 2008
INVENTOR(S) : Kraig A. Willett et al.

It is certified that error appears in the above-identified patent and that said Letters Patent is hereby corrected as shown below:

On the Title Page, Item 57, in the Abstract, Line 4, “rearwurdly” should be -- rearwardly --.

On the Title Page, Item 57, in the Abstract, Line 8, “farther” should be -- further --.

On the Title Page, Item 57, in the Abstract, Line 8, “end” should be -- and --.

At column 1, line 40, “pennanetly” should be -- permanently --.

At column 6, line 25, delete “first”.

At column 6, line 39, “element;” should be -- element: --.

Signed and Sealed this

Sixteenth Day of December, 2008

JON W. DUDAS
*Director of the United States Patent and Trademark Office*